US009227396B2

(12) United States Patent
Fukuda

(10) Patent No.: US 9,227,396 B2
(45) Date of Patent: Jan. 5, 2016

(54) LIQUID EJECTING APPARATUS, AND CONTROL METHOD FOR LIQUID EJECTING APPARATUS

(71) Applicant: SEIKO EPSON CORPORATION, Tokyo (JP)

(72) Inventor: Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/337,913

(22) Filed: Jul. 22, 2014

(65) Prior Publication Data

US 2015/0035883 A1 Feb. 5, 2015

(30) Foreign Application Priority Data

Jul. 30, 2013 (JP) ..... 2013-157319
Jun. 27, 2014 (JP) ..... 2014-132351

(51) Int. Cl.
*B41J 29/38* (2006.01)
*B41J 2/045* (2006.01)

(52) U.S. Cl.
CPC ..... *B41J 2/04541* (2013.01); *B41J 2/0452* (2013.01); *B41J 2/04581* (2013.01); *B41J 2/04588* (2013.01)

(58) Field of Classification Search
CPC ..... B41J 2/04581; B41J 2/04588; B41J 2/04541; B41J 2/04593; B41J 2/0458
USPC ..... 347/10, 9
See application file for complete search history.

(56) References Cited

U.S. PATENT DOCUMENTS

2010/0118073 A1* 5/2010 Kitami et al. ..... 347/10
2012/0206521 A1* 8/2012 Zhang ..... 347/11

FOREIGN PATENT DOCUMENTS

JP 2003-039701 2/2003

* cited by examiner

*Primary Examiner* — Manish S Shah
*Assistant Examiner* — Yaovi Ameh
(74) *Attorney, Agent, or Firm* — Workman Nydegger

(57) ABSTRACT

In a recording suspension period when a recording head is accelerated or decelerated in a non-recording region on a recording medium, or stops moving in the course of performing a printing process (printing job), a second driving signal is generated from a driving signal generation portion. Second vibration driving pulses of the second driving signal are applied to all piezoelectric elements, so that a vibration operation is performed without ejecting the liquid. Since a second reference potential of the second driving signal is set to be lower than a first reference potential of a first driving signal generated in a recording period as much as possible, a general potential (driving voltage) of the second driving signal is reduced, and reduce power consumption in the recording suspension period is reduced. As a result, it is possible to contribute to the power consumption saving of a printer.

6 Claims, 5 Drawing Sheets

LIQUID EJECTING APPARATUS, AND CONTROL METHOD FOR LIQUID EJECTING APPARATUS

The present application claims priority to Japanese Patent Application No. 2013-157319 filed on Jul. 30, 2013 and No. 2014-132351 filed on Jun. 27, 2014, which are hereby incorporated by reference in their entirety.

BACKGROUND

1. Technical Field

Embodiments of the present invention relate to a liquid ejecting apparatus such as an ink jet recording apparatus, and a control method for controlling the liquid ejecting apparatus. More particularly, embodiments of the invention relate to a liquid ejecting apparatus which applies a driving signal to a piezoelectric element so as to drive the piezoelectric element, thereby ejecting a liquid from nozzles, and a control method for controlling the liquid ejecting apparatus.

2. Related Art

A liquid ejecting apparatus is an apparatus that includes a liquid ejecting head and that ejects various liquids from the liquid ejecting head. Examples of the liquid ejecting apparatus include, for example, an image recording apparatus such as an ink jet printer or an ink jet plotter. A liquid ejecting apparatus has been recently applied to various manufacturing apparatuses by utilizing a feature in which a very small amount of liquid can be accurately landed on a predetermined spot. For example, the liquid ejecting apparatus may be applied to or included in a display manufacturing apparatus which manufactures a color filter of a liquid crystal display or the like, an electrode forming apparatus which forms the electrodes of an organic electroluminescence (EL) display or a surface emitting display (FED), and a chip manufacturing apparatus which manufactures a bio chip (biochemical element). In addition, a recording head for the image recording apparatus ejects liquid ink, and a color material ejecting head for the display manufacturing apparatus ejects a solution of each color material of red (R), green (G), and blue (B). Further, an electrode material ejecting head for the electrode forming apparatus ejects a liquid electrode material, and a bioorganic compound ejecting head for the chip manufacturing apparatus ejects a solution of bioorganic compounds.

In these liquid ejecting apparatus, the nozzles are exposed to air during the ejection of the liquid or during a recording operation. The liquid includes a solvent component that easily evaporates through the nozzles. However, if the solvent component has evaporated, there is a concern that the liquid near the nozzles may thicken and that the ejection of the liquid droplets may thus be hindered. Various countermeasures have been taken in order to reduce the thickening of the liquid. For example, in the above-described ink jet printer (hereinafter, simply referred to as a printer), the nozzle surfaces are enclosed by a cap member so that solvent evaporation from the nozzles is minimized when the recording head is in a standby state in which the recording head does not perform ejection or when a recording operation is not being performed.

In addition, a flushing operation, that is, an idle ejection (throwing-away-shot) operation of ink droplets is performed whenever a recording operation is performed for a predetermined time. Thickened ink is discharged from the recording head during the flushing operation.

Further, during execution of a printing process (a liquid ejecting process executed by receiving printing data and a printing command), in a nozzle which does not eject ink, a vibration driving pulse is applied to a pressure generator (for example, a piezoelectric vibrator) corresponding to the nozzle. A meniscus of the nozzle or ink in a pressure chamber communicating with the nozzle that does not eject ink is vibrated to an extent in which the ink in the pressure chamber is not ejected. In other words, the meniscus is slightly vibrated so as to allow the ink to be stirred without actually ejecting any of the ink from the nozzle. This prevents the ink from thickening. Furthermore, this slight vibration operation (e.g., vibration driving pulse) is also performed during the printing process when the recording head is moved to a region (non-recording region) which deviates from or is separated from a region (recording region) where the ink is ejected onto a recording medium (an ink landing target) such as recording paper (refer to JP-A-2003-039701).

Hereinafter, as appropriate, a vibration operation which is performed during a period when the recording head ejects the ink in the recording region in the printing process is referred to as "printing slight vibration", and a slight vibration operation which is performed during a period when the recording head is located at the non-printing region and does not eject the ink in the printing process is referred to as "non-printing slight vibration".

In a general printer, a reference potential of a driving signal in a recording region is made to match a reference potential of a driving signal (a driving signal including a vibration driving pulse for performing a non-printing slight vibration) in a non-recording region. However, in this configuration, the reference potential may be continuously applied to a pressure generator even in the non-recording region. As a result, the power consumption of the printer increases. In contrast, if the driving signal is not applied to the pressure generator in the non-recording region (an applied potential is 0), a non-printing slight vibration is not performed and it is hard to prevent thickening of the ink. Therefore, there is a problem in that the transition from a state in which the applied potential is 0 to a state of execution and restarting of the printing (execution of ejection of ink) is not smoothly performed. A time lag is necessary until a state occurs in which the ink can be ejected.

In addition, these problems occur not only the ink jet recording apparatuses in which recording heads which eject ink but also other liquid ejecting apparatuses which eject a liquid from nozzles by causing a pressure fluctuation in a liquid in a pressure chamber.

SUMMARY

Embodiments of the invention relate to a liquid ejecting apparatus capable of minimizing power consumption, and a control method for controlling the liquid ejecting apparatus or for minimizing or reducing power consumption in a liquid ejecting apparatus.

In an illustrative example, a liquid ejecting apparatus may include a liquid ejecting head that ejects a liquid in a pressure chamber from a nozzle by driving a pressure generator. The liquid ejecting apparatus may also include a driving signal generator that generates a driving signal for driving the pressure generator. The driving signal generator can generate a first driving signal which is applied to the pressure generator in a period when the liquid is ejected onto a landing target, and a second driving signal which is applied to the pressure generator in a period when the liquid is not ejected onto the landing target. A second reference potential which is used as a reference of a potential change in the second driving signal is set to be lower than a first reference potential which is used as a reference of a potential change in the first driving signal.

In one example, because the second reference potential which is used as a reference of a potential change in the second driving signal is set to be lower than the first reference potential which is used as a reference of a potential change in the first driving signal, a general potential of the second driving signal is reduced. Thus, it is possible to reduce power consumption in a period or during a time when the liquid is not ejected onto a landing target. As a result, it is possible to contribute to the power consumption saving of the liquid ejecting apparatus. In other words, it is possible to reduce the power consumed in the liquid ejecting apparatus. In addition, since the second reference potential, which is not 0 or is greater than 0, is applied to each piezoelectric element in the period when liquid is not ejected onto the landing target, it is possible to perform a smooth transition from a liquid ejection suspension state to a liquid ejection operation as compared with a case where a driving signal is not applied (e.g., an applied potential is 0). The transition to a first reference potential from a potential that is higher than 0 can be achieved more smoothly than a transition from an applied potential of 0 to the first reference potential.

In one configuration, the second driving signal includes a driving pulse whose potential is changed from or with respect to the second reference potential. In one example, the driving pulse includes a first waveform part which is changed from the second reference potential to a potential higher than the second reference potential, and a second waveform part which is changed from the higher potential to the second reference potential.

In addition, in one configuration, the driving pulse of the second driving signal may be a vibration driving pulse for vibrating liquids in the pressure chamber and the nozzle to an extent in which the liquid is not ejected from the nozzle. In other words, the vibration driving pulse may vibrate the meniscus without ejecting any ink.

Further, in one configuration, the second reference potential is the lowest potential in a range which can be set in terms of design. The range includes a range that begins at a potential that is greater than 0 and ends at a potential that is less that the first reference potential.

According to one configuration, since the driving pulse includes the first waveform part which is changed from the second reference potential to a potential higher than the second reference potential, and the second waveform part which is changed from the higher potential to the second reference potential, the driving pulse has a waveform with a shape protruding upwardly (a higher potential side than the second reference potential) so as to be changed to a potential higher than the reference potential. Thus the second reference potential can be set to the lowest value in a range which can be set in terms of a specification or design of a driving signal generator. For this reason, it is possible to further reduce power consumption. The second reference potential could also be set to the lowest potential that sill allows a smooth transition to the printing operation.

In one configuration, the first driving signal may include one or more ejection driving pulses whose potentials are changed from the first reference potential so as to eject the liquid from the nozzle, and a vibration driving pulse in an ejection period whose potential is changed from the first reference potential so as to vibrate the liquids in the pressure chamber and the nozzle to an extent in which the liquid is not ejected from the nozzle. The vibration driving pulse in the ejection period may be a pulse whose potential is changed from the first reference potential to a positive potential side, or a pulse whose potential is changed from the first reference potential to a negative potential side.

According to another aspect of embodiments of the invention, a control method for controlling a liquid ejecting apparatus which includes a liquid ejecting head that ejects a liquid in a pressure chamber from a nozzle through driving of a pressure generator, and a driving signal generator that generates a driving signal for driving the pressure generator. The method may include setting a second reference potential, which is used as a reference of a potential change in a second driving signal applied to the pressure generator in a period when the liquid is not ejected onto a landing target, to be lower than a first reference potential which is used as a reference of a potential change in a first driving signal applied to the pressure generator in a period when the liquid is ejected onto the landing target.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, an embodiment of the invention will be described with reference to the accompanying drawings. In addition, the embodiments described below are described with reference to various examples, but the scope of the invention is not limited to such unless the effect of limiting the invention is particularly stated in the following description. Further, in the following, the liquid ejecting apparatus according to embodiments of the invention will be described by exemplifying an ink jet recording apparatus (hereinafter, a printer).

Figure 1:
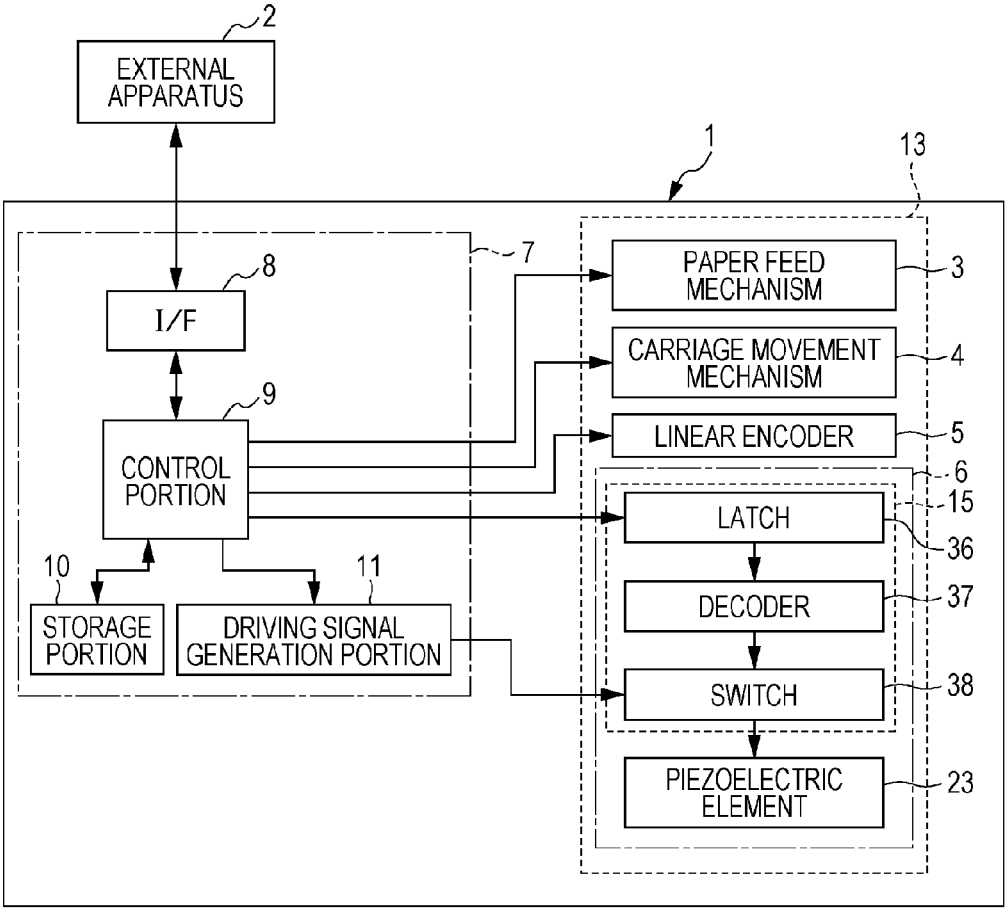
FIG. 1 is a block diagram illustrating an example of an electrical configuration of a printer.
Figure 2:
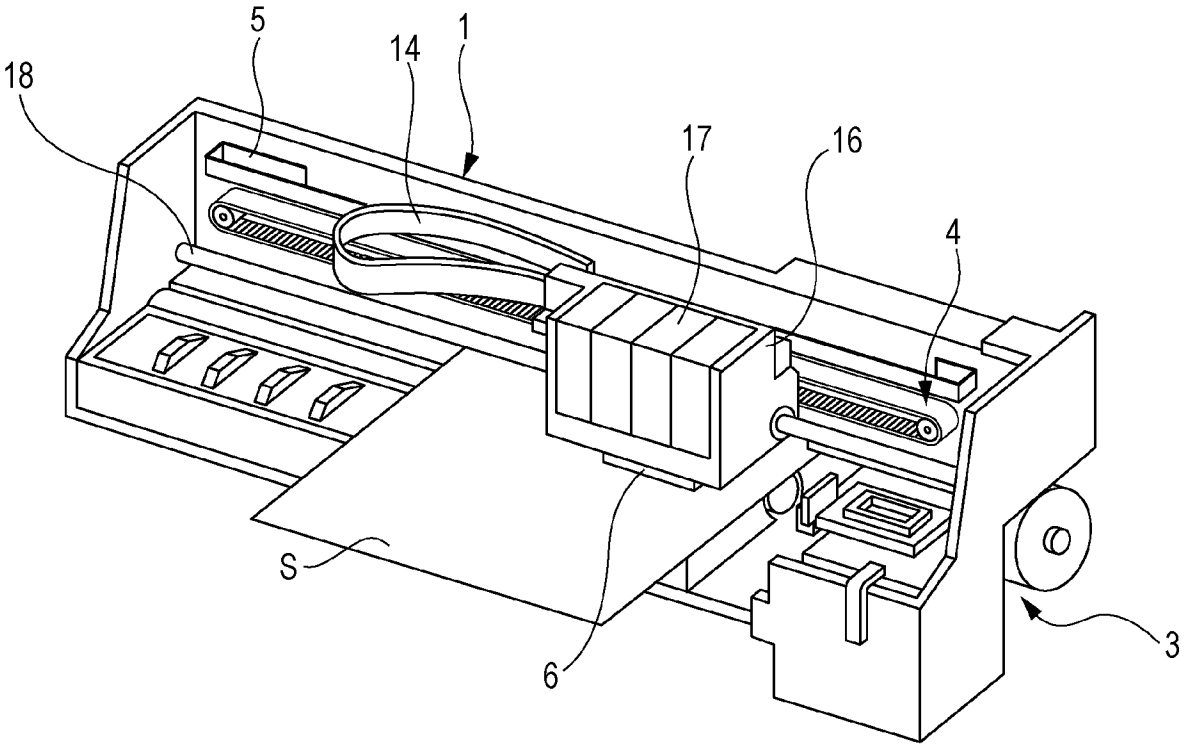
FIG. 2 is a perspective view illustrating an example of an internal configuration of the printer.

FIG. 1 is a block diagram illustrating an example of an electrical configuration of a printer 1, and FIG. 2 is a perspective view illustrating an example of an internal configuration of the printer 1. An external apparatus 2 may be an electronic apparatus such as a computer, a digital camera, or a portable information terminal. The external apparatus 2 is electrically connected to the printer 1 in a wired or wireless manner, and transmits printing data corresponding to an image to the printer 1 so that the printer 1 prints the image or text on a recording medium S such as recording paper.

The printer 1 may include a printer controller 7 and a print engine 13. A recording head 6 may be installed on a bottom side of a carriage 16 in which an ink cartridge (liquid supply source) is mounted. In addition, the carriage 16 is configured to be moved in a reciprocating manner along a guide rod 18 by a carriage movement mechanism 4. In other words, the printer 1 transports the recording medium S (a kind of landing target or recording medium) such as recording paper by using a paper feed mechanism 3, and ejects ink from nozzles 25 (refer to FIG. 3 and the like) of the recording head 6 while relatively moving the recording head 6 in a width direction (main scanning direction) of the recording medium S so that the ink is landed on the recording medium S. Thus, an image or the like is recorded on the recording medium S. In addition, the ink cartridge 17 may be disposed on a main body side of the printer, and ink of the ink cartridge 17 may be sent to the recording head 6 side through a supply tube.

The printer controller 7 may be a control unit which controls each constituent element of the printer. The printer controller 7 may include an interface (I/F) portion 8, a control portion 9, a storage portion 10, and a driving signal generation portion 11. The interface portion 8 transmits and receives state data of the printer when printing data or a printing command is sent from the external apparatus 2 to the printer 1, or when state information of the printer 1 is output to the external apparatus 2. The control portion 9 may be an arithmetic processing portion which controls the entire printer. The storage portion 10 may be an element which stores programs for the control portion 9 and data used for a variety of controls. The storage portion 10 may include a ROM, a RAM, and/or an NVRAM (nonvolatile storage element). The control portion 9 controls each portion according to the program stored in the storage portion 10.

Figure 4A:
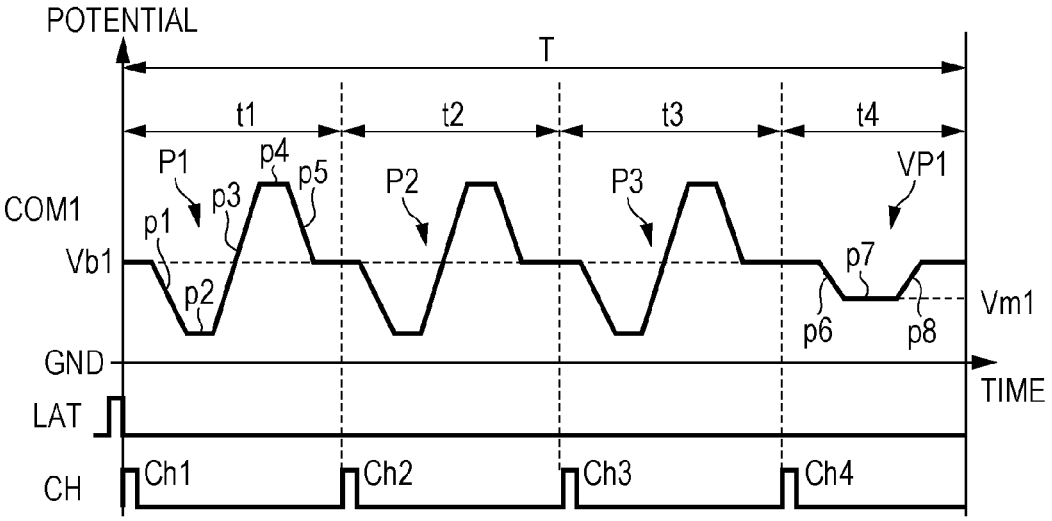
FIGS. 4A and 4B are waveform diagrams illustrating an example of a configuration of a driving signal.
Figure 4B:
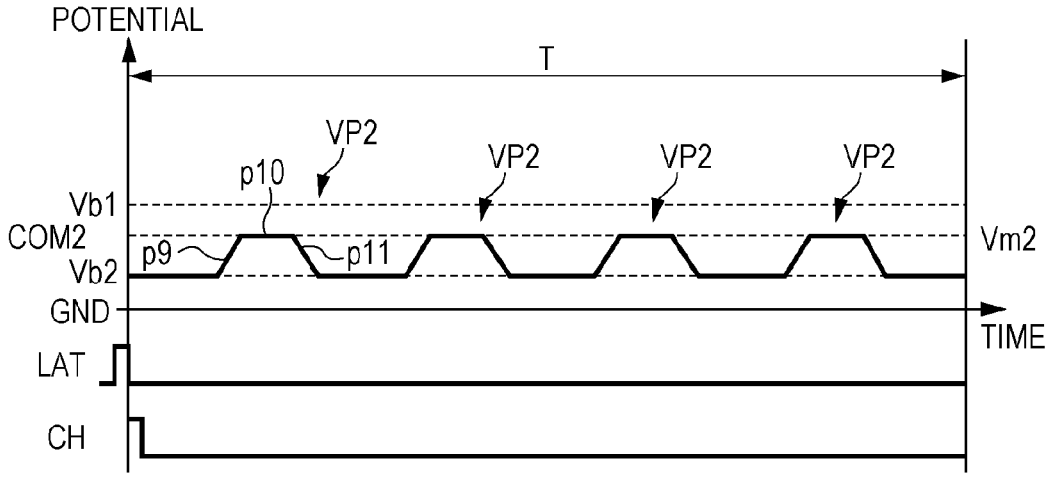

In addition, the control portion 9 may generate dot pattern data (grayscale information) indicating which nozzles 25 eject ink at which timings during a recording operation on the basis of printing data from the external apparatus 2. The control portion 9 transmits the dot pattern data to a head control portion of the recording head 6. The driving signal generation portion 11 generates an analog signal on the basis of waveform data regarding a waveform of a driving signal, and amplifies the analog signal so as to generate driving signals COM (COM1 and COM2) as illustrated in FIGS. 4A and 4B.

Next, the print engine 13 will be described. As illustrated in FIG. 1, the print engine 13 includes the paper feed mechanism 3, the carriage movement mechanism 4, a linear encoder 5, the recording head 6, and the like. The carriage movement mechanism 4 is constituted by or includes the carriage 16 in which the recording head 6 (which is a kind of liquid ejecting head) is mounted, and a driving motor (for example, a DC motor) which makes the carriage 16 travel by using a timing belt or the like, and moves the recording head 6 mounted in the carriage 16 in the main scanning direction. The paper feed mechanism 3 is constituted by or includes a paper feed motor, a paper feed roller, and the like, and sequentially sends out the recording medium S onto a platen so as to perform sub-scanning. In other words, the paper feed mechanism 3 may move the recording medium in the sub-scan direction at certain times. In addition, the linear encoder 5 outputs an encoder pulse corresponding to a scanning position of the recording head 6 mounted in the carriage 16, to the printer controller 7 as positional information in the main scanning direction. The control portion 9 of the printer controller 7 can grasp or determine a scanning position (current position) of the recording head 6 on the basis of the encoder pulse received from the linear encoder 5. Further, the control portion 9 generates a timing signal (e.g., latch signal LAT) for defining a generation timing of the driving signal COM described later on the basis of the encoder pulse.

Figure 3:
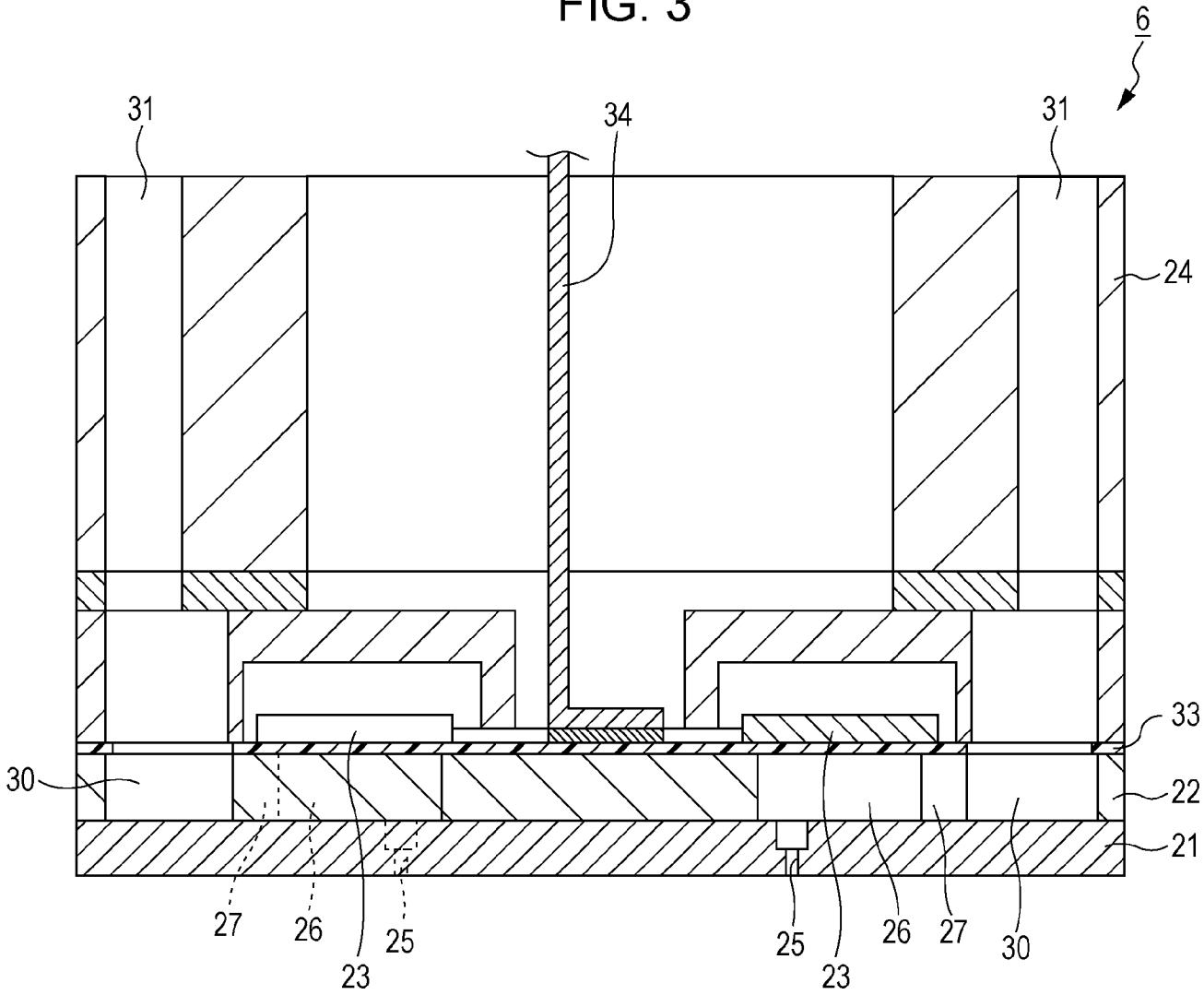
FIG. 3 is a cross-sectional view illustrating an example of a configuration of a recording head.

FIG. 3 is a main part cross-sectional view illustrating an example of an internal configuration of the recording head 6.

The recording head 6 of the present embodiment schematically includes members such as a nozzle plate 21, a flow channel substrate 22, a piezoelectric element 23, and the like, and is installed in a case 24 in a state in which these members are stacked. The nozzle plate 21 is a plate-shaped member in which a plurality of nozzles 25 are opened or formed with a predetermined pitch in a line. In the present embodiment, two nozzle strings or rows each of which is constituted by a plurality of arrayed nozzles 25 are arranged in parallel in the nozzle plate 21.

The flow channel substrate 22 of the present embodiment is a plate member formed of a silicon single crystal substrate in one example. The flow channel substrate 22 is provided with a plurality of pressure chambers 26 which are formed so as to be arranged in the nozzle string direction through anisotropic etching. A pressure chamber string or row is formed by the pressure chambers 26. The pressure chamber 26 is a hollow part which is long in a direction intersecting the pressure chamber array or row direction.

The pressure chambers 26 are provided in a one-to-one relationship with the nozzles 25 of the nozzle plate 21. In other words, a formation pitch of the respective pressure chambers 26 corresponds to a formation pitch of the nozzles 25. In addition, in the flow channel substrate 22, a reservoir 30 which penetrates through the flow channel substrate 22 is formed in the array direction of the pressure chambers 26 for each pressure chamber group in a region which deviates from the pressure chamber 26 in a lateral direction (an opposite side to a communication side with the nozzle 25) of the pressure chamber longitudinal direction. In one example, the pressure chambers 26 may be at least partly located between the nozzle 25 and the reservoir 30. The reservoir 30 is a hollow part which is common to the respective pressure chambers 26 belonging to the same pressure chamber group. The reservoir 30 communicates with each pressure chamber 26 via an ink supply port 27. Each pressure chamber 26 is associated with an ink supply port 27. The ink supply port 27 is formed to have a smaller width than the pressure chamber 26, and is a part that serves as a flow channel resistance to ink which flows from the reservoir 30 into the pressure chamber 26. Further, ink of the ink cartridge 17 side is introduced into the reservoir 30 through an ink supply path 31 of the case 24.

The nozzle plate 21 is adhered to a lower surface (a surface on an opposite side to a joint surface side with an actuator unit) of the flow channel substrate 22 via an adhesive. The nozzle plate 21 is a plate member in which the plurality of nozzles 25 are formed or opened with a predetermined pitch in a line. In the present embodiment and by way of example only, 360 nozzles 25 are provided in a line with a pitch corresponding to 360 dpi so as to form a nozzle string. Each nozzle 25 communicates with the pressure chamber 26 at an end on an opposite side of the pressure chamber 26 relative to the ink supply port 27. In addition, the nozzle plate 21 is formed of, for example, glass ceramics, a silicon single crystal substrate, stainless steel, or the like. In one embodiment, a total of two nozzle strings are provided in the recording head and liquid flow channels corresponding to each nozzle string are provided so as to be horizontally symmetric with respect to the nozzle 25.

The piezoelectric element 23 is formed on an upper surface of the flow channel substrate 22 on an opposite side to the nozzle plate 21 side, via an elastic film 33 (the piezoelectric element 23 is on one side of the flow channel substrate 22 and the nozzle plate 21 is on the other or opposite side of the flow channel substrate). An upper opening of each pressure chamber 26 is closed by the elastic film 33, and the piezoelectric element 23 is formed thereon. The piezoelectric element 23 is formed by sequentially stacking a lower electrode film made of metal or other suitable conductive material, a piezoelectric body layer, and an upper electrode film made of metal or other suitable conductive material. The piezoelectric element 23 may be a piezoelectric element of a so-called flexure mode. Each piezoelectric element 23 is deformed by receiving a driving signal via a wiring member 34. Accordingly, a pressure fluctuation occurs in ink inside the pressure chamber 26 corresponding to the piezoelectric element 23 based on the driving signal, and the ink is ejected from the nozzle 25 by controlling the pressure fluctuation of the ink in the pressure chamber 26.

In addition, when a driving signal (described later) is applied to the upper and lower electrodes of the piezoelectric element 23, an electric field corresponding to an applied potential (applied voltage) is generated between both electrodes. Further, the piezoelectric body is deformed according to an intensity of the applied electric field. In other words, as the applied potential is increased, a central part of the piezoelectric body in a width direction (nozzle string direction) is bent toward a side close to the nozzle plate 21, and thus the elastic film 33 is deformed so as to reduce a volume of the pressure chamber 26. On the other hand, as the applied potential is decreased (moved closer to 0), a central part of the piezoelectric body in a short side direction is bent toward a side separated from the nozzle plate 21, and thus the elastic film 33 is deformed so as to increase a volume of the pressure chamber 26. When the piezoelectric element 23 is driven as mentioned above, a volume of the pressure chamber 26 is changed, and thus a pressure of the ink in the pressure chamber 26 is changed. In addition, by controlling the pressure change of the ink, ink droplets can be ejected from the nozzles 25. Also, by controlling the pressure change of the ink, the meniscuses of the nozzles 25 or the ink in the pressure chamber 26 can be vibrated to an extent in which the ink is not ejected from the nozzles 25. This is an example of vibrating the ink so as to stir the ink and prevent or reduce thickening of the ink.

Next, an example electrical configuration of the recording head 6 will be described.

As illustrated in FIG. 1, the recording head 6 includes a latch circuit 36, a decoder 37, a switch 38, and the piezoelectric element 23. The latch circuit 36, the decoder 37, and the switch 38 form a head control portion 15, and the head control portion 15 is provided for each piezoelectric element 23, that is, for each nozzle 25. The latch circuit 36 latches dot pattern data based on printing data. The dot pattern data is data for controlling ejection and non-ejection of ink from each nozzle. In other words, the dot pattern data is used to control which nozzles eject ink and which nozzles do not eject ink. The decoder 37 outputs a switch control signal for controlling the switch 38 on the basis of the dot pattern data latched in the latch circuit 36. The switch control signal output from the decoder 37 is input to the switch 38. The switch 38 is turned on and off in response to the switch control signal.

FIGS. 4A and 4B are examples of waveform diagrams illustrating a configuration of a driving signal generated by the driving signal generation portion 11. FIG. 4A illustrates a first driving signal COM1 (corresponding to a first driving signal) and FIG. 4B illustrates a second driving signal COM2 (corresponding to a second driving signal). In the present embodiment, a unit cycle T which is a repeated cycle of the driving signals COM1 and COM2 corresponds to a time in which the nozzle 25 is moved by a distance corresponding to a width of a pixel which is a constituent unit of an image in performing ejection of ink while the recording head 6 is relatively moved for the recording medium S. The unit cycle T may be repeated multiple times while the recording head is moved, for example, in the main scan direction. The driving signals COM1 and COM2 are generated in accordance with a latch signal LAT which is a timing signal that is generated on the basis of an encoder pulse corresponding to a scanning position of the recording head 6. Therefore, the driving signals COM1 and COM2 are signals generated at a cycle defined by the latch signal LAT.

The printer 1 of the present embodiment can perform multi-grayscale recording in which dots with different sizes are formed on the recording medium S. The printer 1 can perform, by way of example, a recording operation in a total of four grayscales including a large dot, a medium dot, a small dot, and non-ejection (slight vibration).

In addition, the first driving signal COM1 may be a signal in which a first ejection driving pulse P1, a second ejection driving pulse P2, a third ejection driving pulse P3, and a first vibration driving pulse VP1 (corresponding to a vibration driving pulse within an ejection period in the invention) are generated (in this order in one example) within the unit cycle T. In one example, the ejection period of the first driving signal COM1 may include the pulses P1, P2, P3, and VP1, some of which may be selectively applied according to the dot pattern data.

Further, the second driving signal COM2 may be a signal in which one or more second vibration driving pulses VP2 (corresponding to a driving pulse or a vibration driving pulse) are generated. Furthermore, when the recording head 6 is moved in a recording region on the recording medium S in the course of performing a printing process (printing job) by the printer controller 7 receiving printing data and a printing command (a period when the recording head 6 performs a recording operation of ejecting ink from the nozzle 25, which is hereinafter referred to as a recording period as appropriate), at least one of the driving pulses of the first driving signal COM1 is selectively applied to the piezoelectric element 23 provided in each pressure chamber 26. In other words, at least one of the driving pulses of the first driving signal COM1 is selectively applied to each piezoelectric element 23 during a printing process. This allows various sized dots to be recorded on the recording medium S.

On the other hand, during the printing process, when the recording head 6 is accelerated or decelerated outside the recording region of the recording medium S, or when a movement thereof is stopped (e.g., a period when the recording head 6 does not perform the recording operation of ejecting ink from the nozzle 25, which is hereinafter referred to as a recording suspension period as appropriate), the second driving signal COM2 is applied to all the piezoelectric elements 23. In other words, the so-called non-printing slight vibration is performed during the recording suspension period when the recording head 6 is in the non-recording region. In addition, the recording region indicates a region on the recording medium S where an image, text, and the like are recorded by a dot arrangement (landing pattern) which is formed by landed ink. Therefore, the recording region is different depending on printing content (content of an image or text).

The ejection driving pulses P1 to P3 of the first driving signal COM1 are driving pulses whose waveforms are defined so that ink is ejected from the nozzle 25. Specifically, each of the ejection driving pulses P1 to P3 includes an expansion element p1 for expanding the pressure chamber 26 from a reference volume corresponding to a first reference potential Vb1, an expansion maintaining element p2 for maintaining the expansion state for a specific time, a contraction element p3 for rapidly contracting the pressure chamber 26 so as to eject ink from the nozzle 25, a contraction maintaining element p4 for maintaining the contraction state for a specific time, and an expansion returning element p5 for returning the pressure chamber 26 from the contraction volume to the reference volume. Of course, different volumes of ink could be ejected by configuring the driving pulses differently.

Meanwhile, the first vibration driving pulse VP1 is a driving pulse set to a waveform for vibrating the meniscus to an extent in which ink is not ejected from the nozzle 25 so as to minimize thickening of the ink at the nozzle 25 of the recording head 6 which currently performs a printing process in a recording region. Specifically, the first vibration driving pulse VP1 includes a first vibration expansion element p6 for expanding the pressure chamber 26 from the reference voltage corresponding to the first reference potential Vb1 to a vibration expansion volume which is slightly larger, a vibration expansion maintaining element p7 for maintaining the vibration expansion volume for a specific time, and a first vibration contraction element p8 for returning the pressure chamber from the vibration expansion volume to the reference volume.

All the driving pulses of the first driving signal COM1 change their potentials with the first reference potential Vb1 (corresponding to a first reference potential in the invention) as a base point. All driving pulses change potential relative to the first reference potential Vb1. In other words, a starting end potential or a terminal end potential of each driving pulse is the first reference potential Vb1. As illustrated in FIG. 4A, the first reference potential Vb1 is set to a potential which is considerably higher than a ground potential GND. In addition, the first vibration expansion element p6 of the first vibration driving pulse VP1 is a waveform element whose potential is reduced from the first reference potential Vb1 to a vibration expansion potential Vm1, which is lower than the first reference potential Vb1. Further, the vibration expansion maintaining element p7 is a waveform element for maintaining the vibration expansion potential Vm1 for a specific period, and the first vibration contraction element p8 is a waveform element whose potential is increased from the vibration expansion potential Vm1 to the first reference potential Vb1. Therefore, the first vibration driving pulse VP1 has a waveform with a shape protruding downwardly (GND side or towards GND from Vb1). Furthermore, the first vibration driving pulse VP1 may be a waveform with a shape protruding upwardly (an opposite side (high potential side) toward the GND side with respect to the first reference potential Vb1).

In the present embodiment, a size of a dot formed on the recording medium S is changed depending on the number of selected ejection driving pulses included in the driving signal COM. In a case of non-recording in which a dot is not formed on the recording medium S in the unit cycle T, that is, ink is not ejected from the nozzle 25, the first vibration driving pulse VP1 is applied to the piezoelectric element 23 corresponding to the nozzle 25 of the non-recording.

When the first vibration driving pulse VP1 is applied to the piezoelectric element 23, a relatively smooth pressure fluctuation occurs in the ink of the pressure chamber 26, and the meniscus exposed to or in the nozzle 25 is vibrated (slightly vibrated) due to the vibration fluctuation or due to the pulse VP1. Thickened ink around the nozzle 25 is distributed due to the slight vibration of the meniscus, and, as a result, thickening of the ink or liquid at the meniscus is reduced.

In a case where a small dot is formed on the recording medium S during the unit cycle T, the second ejection driving pulse P2 is selected and is applied to the piezoelectric element 23. Accordingly, the ink is ejected from the nozzle 25 once, and thus a small dot is formed on the recording medium S. The pulse VP1 may also be optionally applied in the case of forming the small dot, the medium dot and/or the large dot.

Similarly, in a case where a medium dot is formed on the recording medium S during the unit cycle T, the first ejection driving pulse P1 and the third ejection driving pulse P3 are selected and are sequentially applied to the piezoelectric element 23. Accordingly, the ink is ejected from the nozzle 25 twice during the same unit cycle T. If the ink is landed on a predetermined pixel region of the recording medium S, a medium dot is formed.

In addition, in a case where a large dot is formed on the recording medium S during the unit cycle T, the first ejection driving pulse P1, the second ejection driving pulse P2, and the third ejection driving pulse P3 are selected and are sequentially applied to the piezoelectric element 23. Accordingly, the ink is ejected from the nozzle 25 continuously three times. If the ink is landed on a predetermined pixel region of the recording medium S, a large dot is formed. Further, the term "large or small" indicating a size of a dot is relative, and an actual size of the dot or a liquid amount is defined according to a specification of the printer 1.

The second vibration driving pulse VP2 of the second driving signal COM2 is a driving pulse set to a waveform for vibrating the meniscus to an extent in which ink is not ejected from the nozzle 25 so as to minimize thickening of the ink at the nozzle 25 in the recording suspension period when the recording head 6 which currently performs a printing process is located in a non-recording region. This can prevent the ink or other liquid from thickening even when ink is not being ejected from the recording head 6.

The second vibration driving pulse VP2 includes a second vibration contraction element p9 (corresponding to a first waveform part) for contracting the pressure chamber 26 from a reference volume corresponding to a second reference potential Vb2 to a vibration contraction volume corresponding to a reference voltage Vm2. The second vibration driving pulse VP2 also includes a vibration contraction maintaining element p10 for maintaining the vibration contraction volume for a specific time, and a second vibration expansion element p11 (corresponding to a second waveform part in the invention) for returning the pressure chamber 26 from the vibration contraction volume to the reference volume. In one embodiment, a total of four vibration driving pulses VP2 are generated in a period corresponding to the unit cycle T in the first driving signal COM1, and all of the pulses change their potentials with the second reference potential Vb2 as a base point or with respect to the second reference potential Vb2. In other words, a starting end potential or a terminal end potential of the second vibration driving pulse VP2 of the second driving signal COM2 is the second reference potential Vb2. In addition, as illustrated in FIG. 4B, the second reference potential Vb2 is set to a potential lower than the first reference potential Vb1. In one example, the reference potential Vb2 is set as much as possible lower.

In one example, the second reference potential Vb2 is the lowest potential in a range which can be set in terms of a specification or design of the driving signal generation portion 11, and may be specifically set to 2.5 V.

The second vibration contraction element p9 of the second vibration driving pulses VP2 is a waveform element whose potential is increased from the second reference potential Vb2 to a vibration contraction potential Vm2 which is higher than the second reference potential Vb2. Further, the vibration contraction maintaining element p10 is a waveform element for maintaining the vibration contraction potential Vm2 for a specific period, and the second vibration expansion element p11 is a waveform element whose potential is reduced from the vibration contraction potential Vm2 to the second reference potential Vb2. Therefore, the second vibration driving pulse VP2 has a waveform with a shape protruding upwardly (an opposite side (high potential side) toward the GND side with respect to the second reference potential Vb2). In other words, the waveform has a shape that increases relative to GND and with respect to the reference potential Vb2. In one example, the vibration contraction potential Vm2 is less than the potential Vb1. When the COM2 signal is applied, one or more of the vibration driving pulses VP2 may be selected and applied to each of the nozzles.

Figure 5:
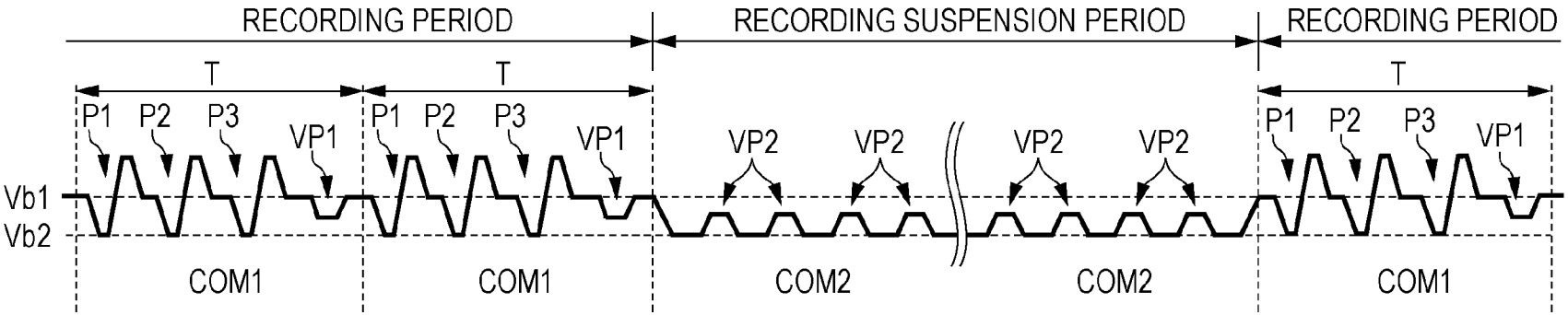
FIG. 5 is a timing chart illustrating examples of generation timings of a driving signal in a printing process.

FIG. 5 is a timing chart illustrating examples of generation timings of the driving signals in a printing process of the printer 1. As illustrated in FIG. 5, in a recording period when the recording head 6 is moved in a recording region on or with respect to the recording medium S in the course of performing a printing process (printing job) by the printer controller 7 receiving printing data and a printing command, the first driving signal COM1 is generated from the driving signal generation portion 11 whenever the latch signal LAT is generated in accordance with the movement of the recording head 6 (for each unit cycle T). In addition, any one (or more) of the driving pulses of the first driving signal COM1 is applied to the piezoelectric element 23 on the basis of gray-scale information of dot pattern data. Accordingly, an ink ejection operation on the recording medium S or a vibration operation on a non-ejecting nozzle is performed. On the other hand, in a recording suspension period when the recording head 6 is accelerated or decelerated in a non-recording region on the recording medium S, or stops moving in the course of performing the printing process (printing job), the second driving signal COM2 is generated from the driving signal generation portion 11. In addition, the respective second vibration driving pulses VP2 of the second driving signal COM2 are applied to all the piezoelectric elements 23 of the recording head 6, so that a vibration operation is performed for all of the piezoelectric elements 23. Accordingly, thickening of the ink of the recording head 6 in or during the recording suspension period is minimized.

Because the second reference potential Vb2 of the second driving signal COM2 generated in the recording suspension period is set to be lower than the first reference potential Vb1 of the first driving signal COM1 generated in the recording period, as much as possible, a general potential (driving voltage) of the second driving signal COM2 is reduced. As a result, it is possible to reduce power consumption in or during the recording suspension period. As a result, it is possible to contribute to the power consumption saving of the printer 1.

In addition, in the present embodiment, since the second vibration driving pulse VP2 has a waveform with an upwardly protruding shape, the second reference potential Vb2 can be set to the lowest value in a range which can be set in terms of a specification or design of the driving signal generation portion 11. For this reason, it is possible to further reduce power consumption. Further, since the second reference potential Vb2, which is not at least 0 or which is greater than 0, is applied to each piezoelectric element 23 in the recording suspension period, it is possible to reduce a time lag until a state occurs in which ink can be ejected when the recording head is moved from the non-recording region to the recording region as compared with a case where a driving signal is not applied (an applied potential is 0). As a result, it is possible to perform a smooth transition from a recording suspension state to a recording operation.

The invention is not limited to the embodiment, and may be variously modified on the basis of the disclosure of the claims.

For example, the number or kind of each driving pulse of the first driving signal COM1 is not limited to the examples disclosed, and driving pulses with various configurations may be employed. Further, the number of generated driving pulses may be one or more. Similarly, the number of second vibration driving pulses VP2 generated per unit cycle in the second driving signal COM2 is not limited to four, and may be three or less and may be five or more.

In addition, there may be a configuration in which the second vibration driving pulse VP2 is not included in the second driving signal COM2. In other words, in the recording suspension period, only the second reference potential Vb2 may be continuously applied to each piezoelectric element 23. In relation to a waveform of the second vibration driving pulse VP2, the second vibration driving pulse VP2 preferably has a waveform protruding upwardly from the viewpoint of setting the second vibration driving pulse VP2 so as to be as low as possible.

In addition, there may be a configuration in which, in the recording suspension period, a third driving signal COM3 different from the first driving signal COM1 and the second driving signal COM2 is generated during a deceleration period until the recording head 6 stops moving or an acceleration period until the recording head 6 is moved into the recording region from a state in which the movement is stopped, and a third reference potential Vb3 which is a reference potential of the third driving signal COM3 is set to a value between the first reference potential Vb1 and the second reference potential Vb2.

In other words, a potential of the third reference potential Vb3 may be changed in stages between the first reference potential Vb1 and the second reference potential Vb2. Further, there may be a configuration in which the third reference potential Vb3 is set to a potential which causes an electric field due to a hysteresis characteristic of the piezoelectric body of the piezoelectric element 23 to be zero, and the second reference potential Vb2 with a potential lower than zero is set to a potential which may cause a polarization state of the piezoelectric element 23 to be changed when applied to the piezoelectric element 23 for a long time. Furthermore, the third driving signal COM3 is applied to the piezoelectric element 23 in a standby state (whose continuity period is relatively long) prior to a printing process, and the second driving signal COM2 is applied to the piezoelectric element 23 in the recording suspension period, or in a standby state (whose continuity period is relatively short) of a non-recording cycle during the recording period. In other words, the third driving signal COM3 is suitable for a case where the standby time is relatively long since a polarization state of the piezoelectric body is hardly changed even when applied to the piezoelectric element 23 for a long time, and the second driving signal COM2 is suitable for a case where the standby time is relatively short since the polarization state of the piezoelectric body may possibly change when applied to the piezoelectric element 23 for a long time. As mentioned above, the second driving signal COM2 and the third driving signal COM3 are used in a divided manner depending on the standby continuity time, and thus it is possible to more effectively minimize thickening of ink and also to reduce power consumption.

The second driving signal COM2 may include a maintenance driving pulse which is called a flushing driving pulse for forcing ink to be discharged from the nozzle 25, as a driving pulse in the invention. Accordingly, the recording head 6 is moved to a flushing point (ink receiving portion) provided in a movement range of the recording head 6 even during the recording suspension period, and the maintenance driving pulse is applied to the piezoelectric element 23, thereby performing a flushing process. From the viewpoint of setting the second vibration driving pulse VP2 to be as low as possible, the maintenance driving pulse may also have a waveform with an upwardly protruding shape in the same manner as the second vibration driving pulse VP2.

In addition, although a so-called flexure vibration type piezoelectric element 23 has been exemplified as a pressure generator, embodiments of the invention are not limited thereto. For example, a so-called longitudinal vibration piezoelectric element may be employed. In this case, each driving pulse exemplified in the embodiment has a waveform in which a change direction of a potential is vertically inverted. However, from the viewpoint of setting the second vibration driving pulse VP2 to be as low as possible, the second vibration driving pulse VP2 has a waveform with an upwardly protruding shape regardless of the kind of pressure generator.

In addition, the pressure generator is not limited to a piezoelectric element, and the same operations and effects can be achieved even when embodiments of the invention are applied to a case of using various pressure generators such as a heat generation element which generates foam in a pressure chamber, and an electrostatic actuator which changes a volume of a pressure chamber by using an electrostatic force.

Furthermore, embodiments of the invention are applicable to not only a printer, but also various ink jet recording apparatuses such as a plotter, a facsimile apparatus, and a copier, as long as the apparatuses are liquid ejecting apparatuses which can drive a piezoelectric element by applying a driving pulse thereto, so as to control ejection of a liquid.

What is claimed is:

1. A liquid ejecting apparatus comprising:

a liquid ejecting head that ejects a liquid in a pressure chamber from a nozzle through driving of a pressure generator, the liquid ejecting head including a plurality of nozzles and a plurality of pressure generators; and a driving signal generator that generates a driving signal for driving the pressure generator, wherein the driving signal generator can generate:

a first driving signal specific for each pressure generator, the first driving signal is applied to the specific pressure generator in a period when the liquid is ejected onto a landing target, and a second driving signal which is applied to the pressure generator in a period when the liquid is not ejected onto the landing target when the liquid ejecting head is outside of the landing target, the second driving signal having a vibration contraction maintaining waveform part set at a vibration contraction potential, and wherein a second reference potential which is used as a reference of a potential change in the second driving signal and the vibration contraction potential are each set to be lower than a first reference potential which is used as a reference of a potential change in the first driving signal.

2. The liquid ejecting apparatus according to claim 1, wherein the second driving signal includes a driving pulse whose potential is changed from the second reference potential, and wherein the driving pulse includes a first waveform part which is changed from the second reference potential to a potential higher than the second reference potential, and a second waveform part which is changed from the higher potential to the second reference potential, the vibration contraction maintaining waveform part being disposed between the first waveform part and the second waveform part.

3. The liquid ejecting apparatus according to claim 2, wherein the driving pulse of the second driving signal is a vibration driving pulse for vibrating liquids in the pressure chamber and the nozzle to an extent in which the liquid is not ejected from the nozzle.

4. The liquid ejecting apparatus according to claim 1, wherein the second reference potential is a lowest potential in a range which can be set in terms of design.

5. The liquid ejecting apparatus according to claim 2, wherein the first driving signal includes an ejection driving pulse whose potential is changed from the first reference potential so as to eject the liquid from the nozzle, and a vibration driving pulse in an ejection period whose potential is changed from the first reference potential so as to vibrate the liquids in the pressure chamber and the nozzle to an extent in which the liquid is not ejected from the nozzle, and wherein the vibration driving pulse in the ejection period is a pulse whose potential is changed from the first reference potential to a positive potential side, or a pulse whose potential is changed from the first reference potential to a negative potential side.

6. A control method for a liquid ejecting apparatus which includes a liquid ejecting head that ejects a liquid in a pressure chamber from a nozzle through driving of a pressure generator, the liquid ejecting head including a plurality of nozzles and a plurality of pressure generators, and a driving signal generator that generates a driving signal for driving each of the pressure generators, the method comprising:

setting both a second reference potential which is used as a reference of a potential change in a second driving signal applied to each specific pressure generator of the plurality of pressure generators in a period when the liquid is not ejected onto a landing target and a vibration contraction potential of a vibration contraction maintaining waveform part of the second driving signal, to be lower than a first reference potential which is used as a reference of a potential change in a first driving signal applied to the pressure generator in a period when the liquid is ejected onto the landing target, the first driving signal being specific for each generator of the plurality of pressure generators and the second driving signal being applied to the pressure generators in a period when the liquid is not ejected onto the landing target when the liquid ejection head is outside of the landing target.

* * * * *